US010663236B2

(12) United States Patent
De Roeck

(10) Patent No.: US 10,663,236 B2
(45) Date of Patent: May 26, 2020

(54) TUBE HEAT EXCHANGER AND METHOD OF MANUFACTURING SUCH A HEAT EXCHANGER

(71) Applicant: ATLAS COPCO AIRPOWER, NAAMLOZE VENNOOTSCHAP, Wilrijk (BE)

(72) Inventor: Franky Marc De Roeck, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 91 days.

(21) Appl. No.: 16/086,348

(22) PCT Filed: Mar. 2, 2017

(86) PCT No.: PCT/BE2017/000017
§ 371 (c)(1),
(2) Date: Sep. 19, 2018

(87) PCT Pub. No.: WO2017/165928
PCT Pub. Date: Oct. 5, 2017

(65) Prior Publication Data

US 2019/0107339 A1 Apr. 11, 2019

(30) Foreign Application Priority Data

Mar. 31, 2016 (BE) ..... 2016/5228

(51) Int. Cl.
*F28D 7/02* (2006.01)
*F28F 9/22* (2006.01)
*F28D 7/16* (2006.01)

(52) U.S. Cl.
CPC ..... *F28F 9/22* (2013.01); *F28D 7/16* (2013.01); *F28F 2009/226* (2013.01); *F28F 2275/122* (2013.01); *F28F 2275/14* (2013.01)

(58) Field of Classification Search
CPC .. F28F 9/22; F28F 2009/226; F28F 2275/122; F28F 2275/14; F28D 7/16
(Continued)

(56) References Cited

U.S. PATENT DOCUMENTS 2,460,660 A 2/1949 Tinker
4,299,276 A * 11/1981 Small ..... F28D 7/06 165/162
(Continued)

FOREIGN PATENT DOCUMENTS

DE 2657666 A1 12/1977
DE 2713257 A1 9/1978
(Continued)

OTHER PUBLICATIONS

International Search Report in related PCT Application No. PCT/BE2017/000017, dated Sep. 21 2017.
(Continued)

*Primary Examiner* — Davis D Hwu
(74) *Attorney, Agent, or Firm* — Bacon & Thomas, PLLC

(57) ABSTRACT

Shell and tube heat exchanger for exchanging heat between a first and second fluid, that comprises a housing in which tubes extend, whereby baffles are affixed in the housing that are provided with passages, whereby the tubes extend through the said passages, whereby the baffles are connected to one another at a distance from one another by means of one or more fastening elements that are affixed in first recesses in the baffles, whereby one or more connections between a baffle and a fastening element are formed by means of one or more lips that are made at an edge of a first recess, whereby the one or more lips form part of the baffle and are bent over, out of the plane defined by the baffle.

14 Claims, 5 Drawing Sheets

(58) Field of Classification Search
USPC ..... 165/164
See application file for complete search history.

(56) References Cited

U.S. PATENT DOCUMENTS

| | | | | |
|---|---|---|---|---|
| 4,493,368 | A * | 1/1985 | Gronnerud | F28F 9/0131 165/159 |
| 5,894,883 | A * | 4/1999 | Gentry | F28D 7/0066 165/159 |
| 2010/0243208 | A1* | 9/2010 | Kar | B01J 8/067 165/96 |
| 2016/0018168 | A1* | 1/2016 | Urbanski | F28F 9/22 165/159 |

FOREIGN PATENT DOCUMENTS

| | | |
|---|---|---|
| EP | 2480850 B1 | 5/2015 |
| GB | 1310429 | 3/1973 |
| GB | 2070758 A | 9/1981 |

OTHER PUBLICATIONS

Written Opinion in related PCT Application No. PCT/BE2017/000017, dated Sep. 21, 2017.

* cited by examiner

TUBE HEAT EXCHANGER AND METHOD OF MANUFACTURING SUCH A HEAT EXCHANGER

The present invention relates to a shell and tube heat exchanger and to a method for manufacturing this.

BACKGROUND OF THE INVENTION

Shell and tube heat exchangers for exchanging heat between two fluids, a first and second fluid respectively, are already known, whereby the heat exchanger is made up of a housing in which one or more tubes extend that are fastened at their ends to partitions that divide the housing into three compartments, i.e. an inlet compartment and an outlet compartment for the first fluid, and a central compartment between them with its own inlet and outlet for the second fluid.

In conventional shell and tube heat exchangers, one or more baffles are provided transverse to the direction of the tubes and the tubes extend through passages in these baffles in order to guide the flow of the second fluid according to a certain pattern.

Traditionally the baffles are mounted such that a passage is left free for the second fluid, alternately on the one side and the opposite side of the housing, so that the second fluid follows a zigzag pattern.

In the known heat exchangers, the baffles are kept at a distance from one another by fastening means in the form of spacer bushes or spacer plates that are affixed between the baffles.

In the case of spacer bushes, at least one threaded rod is affixed through each series of spacer bushes located in line with one another, all such that these threaded rods also extend through the respective passages in the baffles.

A disadvantage of such a conventional arrangement is that the threaded rods and the spacer bushes must be made of a sufficiently thick material as the movement of the baffles, as a result of the flow of the second fluid through the central compartment, must be limited.

The large quantity of material required of course implies high material costs.

Another disadvantage is that the placement of the baffles is laborious such that the assembly of the tube heat exchanger is labour-intensive and thus expensive.

An alternative is described in EP 2480850 wherein a fastening element in the form of a grooved V-profile is pressed together and snapped into recesses on the periphery of the baffles, more specifically under lips that are affixed at the edges of these recesses.

This has the disadvantage that the squeezing together of these V-shaped profiles requires a substantial force, so that the V-shaped profiles necessarily must be made of relatively thin material, which again has the result that the rigidity of the construction obtained is limited.

At the same time it is not easy to exert a significant force for squeezing the V-shaped profiles together and to accurately manipulate these profiles in order to place them in the recesses in the baffles.

SUMMARY OF THE INVENTION

The purpose of the present invention is to provide a solution to one or more of the aforementioned and/or other disadvantages by providing a shell and tube heat exchanger for exchanging heat between a first and second fluid, whereby the heat exchanger comprises a housing in which one or more tubes extend between an inlet section for the first fluid and an outlet section for the first fluid, whereby baffles are affixed in the housing for imposing a flow path on the second fluid, whereby the baffles are provided with passages, whereby the one or more tubes extend through the said passages, whereby the baffles are connected to one another at a distance from one another by means of one or more fastening elements that are affixed in first recesses in the baffles, whereby one or more connections between a said baffle and a said fastening element are formed by means of one or more lips that are made at the edge of a first recess, whereby the one or more lips form part of the baffle and whereby the one or more lips are bent over, i.e. plastically deformed from the plane defined by the baffle.

Such a shell and tube heat exchanger is easy is to manufacture.

It is sufficient to place the baffles, with the lips not yet bent, at correct distances from one another, for example on an assembly table suitable to this end, after which the one or more fastening elements can be easily placed in the first recesses and can be fastened by bending the one or more lips with a tool suitable for this purpose.

Another advantage is that the fastening element and the baffles can be made of the same material so that fewer logistics are required for the assembly of the shell and tube heat exchanger according to the invention.

Preferably the said one or more fastening elements are each connected to all the said baffles.

In a preferred embodiment the fastening elements are essentially constructed as profiles, whereby the form of the first recesses corresponds to the form of the outer periphery of these profiles, viewed in the cross-section transverse to the profile direction, and whereby optionally these profiles are provided with second recesses at the location of the first recesses, or are provided with protrusions just next to the first recesses.

As a result the baffles and fastening elements are fastened with respect to one another in two directions, i.e. in a direction parallel to the planes defined by the baffles and in a direction parallel to the profile direction of the fastening elements.

Now an assembly table is not needed because the baffles can be connected to the one or more fastening elements one by one, whereby the fastening elements can be prepared beforehand with the recesses or protrusions at a distance from one another that corresponds to the desired distance between the baffles.

The invention also concerns, separately or as part of a method for manufacturing a shell and tube heat exchanger, a method for fastening baffles of a heat exchanger to one another at a desired distance from one another, whereby the baffles are provided with one or more first recesses for receiving one or more fastening elements that at least span the desired distance, whereby the baffles are provided with one or more lips that are affixed at the edge of such a first recess, whereby this method comprises the following step:

the bending of the one or more lips until they protrude outside the plane defined by the baffle.

BRIEF DESCRIPTION OF THE DRAWINGS

With the intention of better showing the characteristics of the invention, a preferred embodiment of a shell and tube heat exchanger and a baffle according to the invention are described hereinafter by way of an example without any limiting nature, with reference to the accompanying drawings, wherein:

FIGS. 2 and 3 schematically show a perspective view of components of the shell and tube heat exchanger of FIG. 1 before they are fastened together;

DETAILED DESCRIPTION OF THE INVENTION

Figure 1:
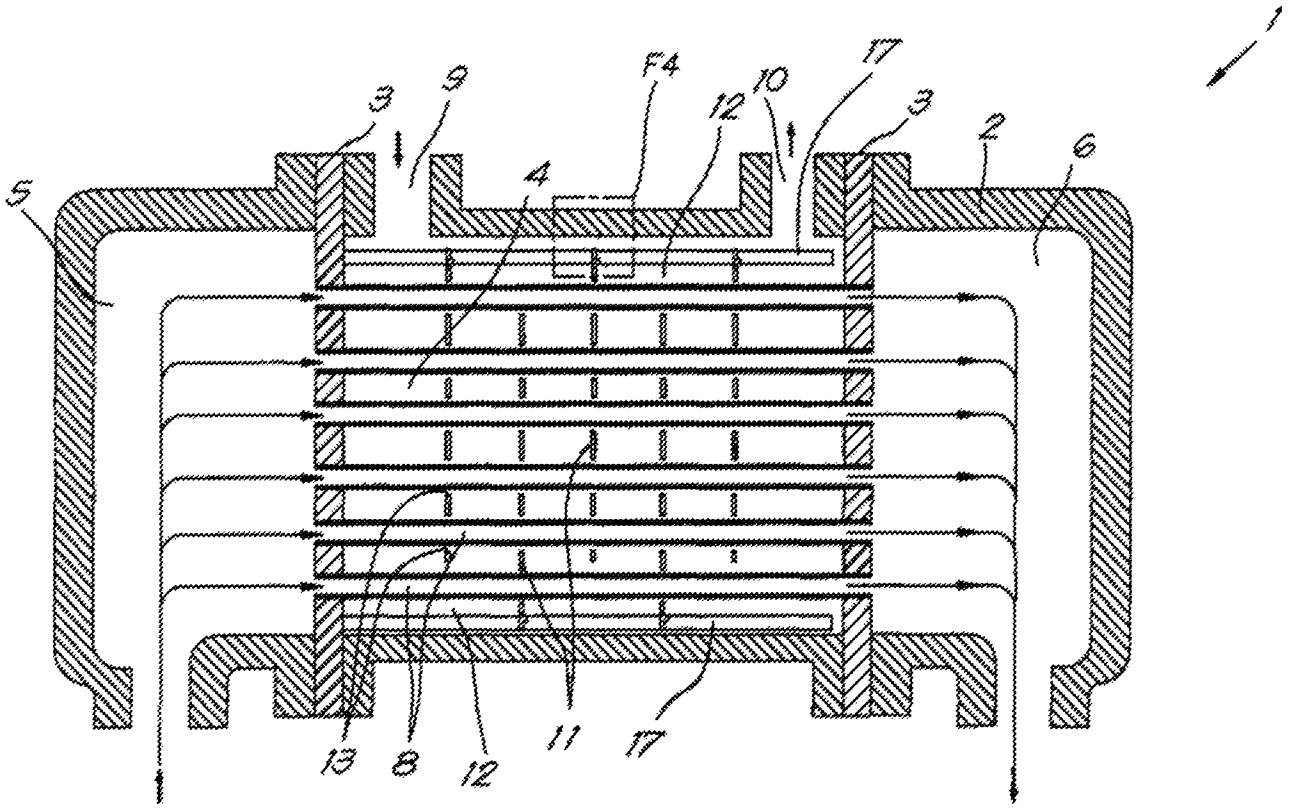
FIG. 1 schematically shows a cross-section of a shell and tube heat exchanger according to the invention.

FIG. 1 schematically shows a shell and tube heat exchanger 1 according to the invention that essentially comprises a closed housing 2 that is divided into three compartments 4 to 6 by means of end pieces in the form of two parallel partitions, i.e. a central compartment 4 and two compartments 5 and 6 on either side of it.

The central compartment 4 is between the aforementioned partitions 3, and passages are provided in the partitions 3 through which parallel tubes 8 extend.

The aforementioned tubes 8 form a connection between the two other compartments 5 and 6 on either side of the central compartment 4, i.e. the compartment 5 that forms an inlet section for a first fluid, and the compartment 6 that forms an outlet section for this first fluid.

The central compartment 4 is provided with an inlet 9 and an outlet 10 for a second fluid, and with 'baffles' 11 that are oriented transverse to the longitudinal direction of the tubes 8.

The form and relative position of the baffles 11 is thereby chosen such that it imposes a certain flow pattern on the second fluid, such as for example a zigzag pattern whereby the second fluid flows through the central compartment according to a back and forth movement a number of times.

To this end the baffles 11 extend from one side of the central compartment 4 to a certain distance from the other side of the central compartment 4 to form a reversing passage 12 for the second fluid, and this in a way such that the successive reversing passages 12 are alternately on the one or the other side.

The baffles 11 are preferably made of a stainless steel, but the invention is by no means limited to this.

The baffles 11 are provided with passages 13 through which the tubes 8 of the heat exchanger 1 run.

The aforementioned passages 13 have a diameter that practically corresponds to the diameter of the tubes 8, such that there is a limited clearance between the baffles 11 and the tubes 8.

The baffles 11 are provided on their periphery with V-shaped first recesses 14. The number of them depends on the required rigidity of the mutual connection of the baffles 11.

The first recesses 14 can be provided with an additional opening 15 close to their closed side, all such that no sharp point occurs that could be a starting point for cracks, however this is not necessary if the radius at the point of the first recesses 14 is sufficiently large and/or if the material of the baffles is sufficiently resistant to crack formation.

On the periphery of the baffles 11, the baffles 11 are provided with two lips 16 at every first recess 14, that protrude in the first recess 14.

This can be seen in particular in FIG. 3.

Figure 2:
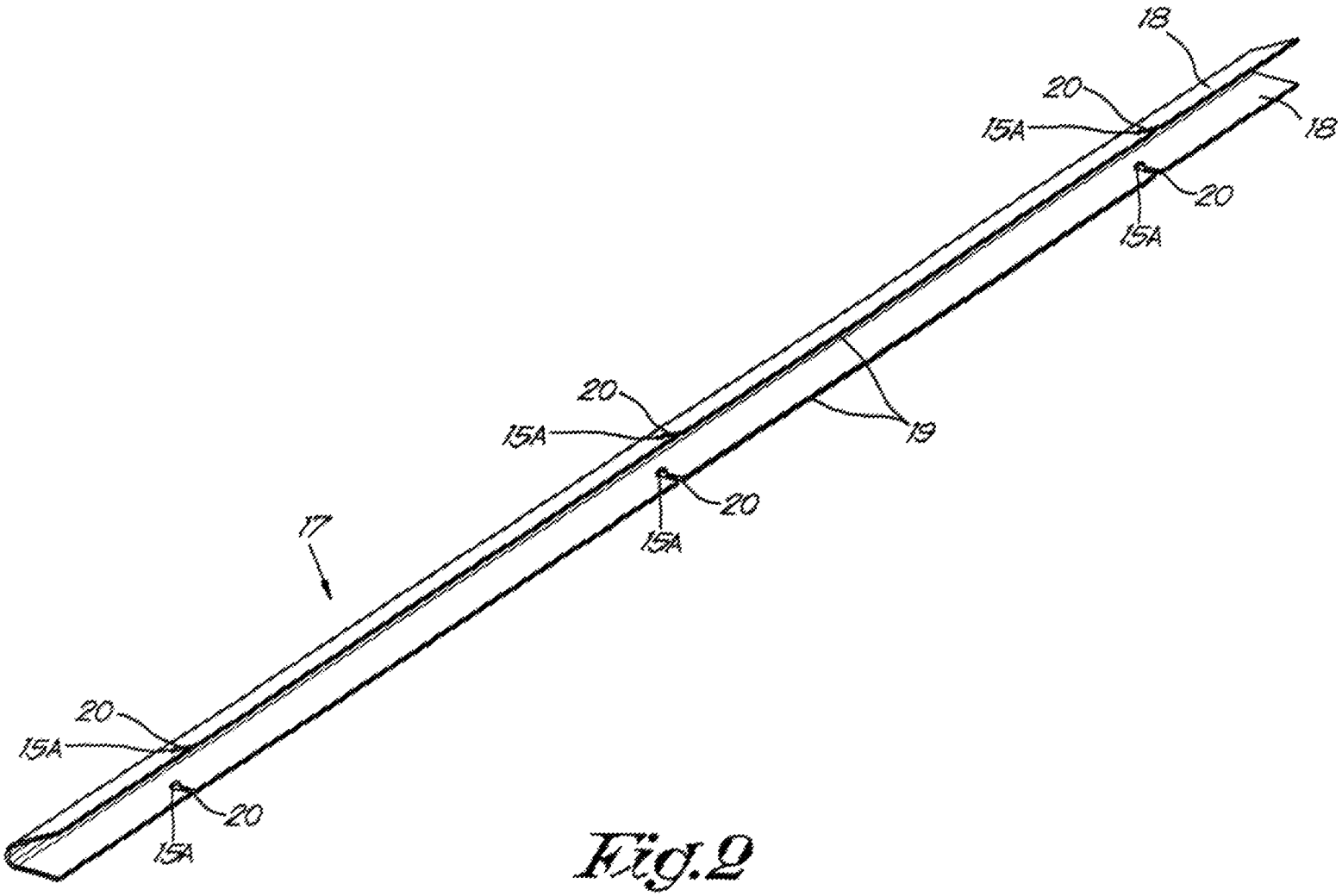

The baffles 11 are held at a distance from one another by means of fastening elements 17, whereby each fastening element 17 is formed by a V-shaped profile, as shown in FIG. 2, with two walls 18 and tapering towards one another, whereby this profile is preferably made of stainless steel.

At the free edges 19 of these walls 18, a number of second recesses 20 are provided opposite one another that have a width that is somewhat larger than the thickness of the baffles 11, and which are affixed over the length of the profile at the desired mutual distance from the baffles 13.

In this example, but not necessarily, the second recesses 20 are provided with an additional opening ISA, ail such that no sharp corners occur that could be a starting point for cracks.

The dimensions, viewed in the cross-section transverse to the longitudinal direction, of the fastening elements 17 are such that they fit in the first recesses 14 without the fastening elements 17 having to be deformed.

The fastening elements 17 extend parallel to the tubes 8 over the full distance between the baffles 11 located the furthest from one another.

The connection between the baffles 11 and the fastening elements 17 is formed by the fastening elements being placed in the first recesses of the baffles 11 at the location of the second recesses, after which the lips 16, as will be explained later, are bent out of the plane of the baffles 11, whereby they are bent around an edge of the second recess 20. This is shown in particular in FIGS. 4 to 7.

As a result a movement of the fastening elements 17 in the radial direction of the baffles 11 is not possible, or only to a very limited extent, and a longitudinal movement of the baffles 11 in the longitudinal direction of the fastening elements is also not possible, or only to a very limited extent.

Figure 5:
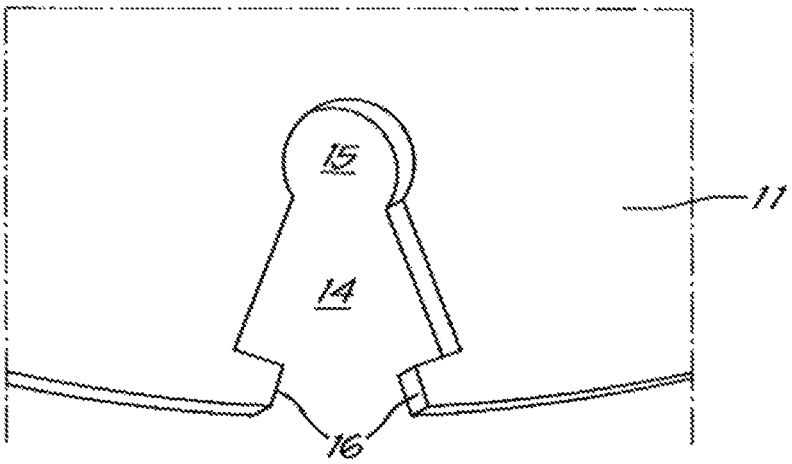
FIGS. 5 and 6 show cross-sections on a larger scale, respectively according to line V-V and line VI-VI in FIG. 4.
Figure 4:
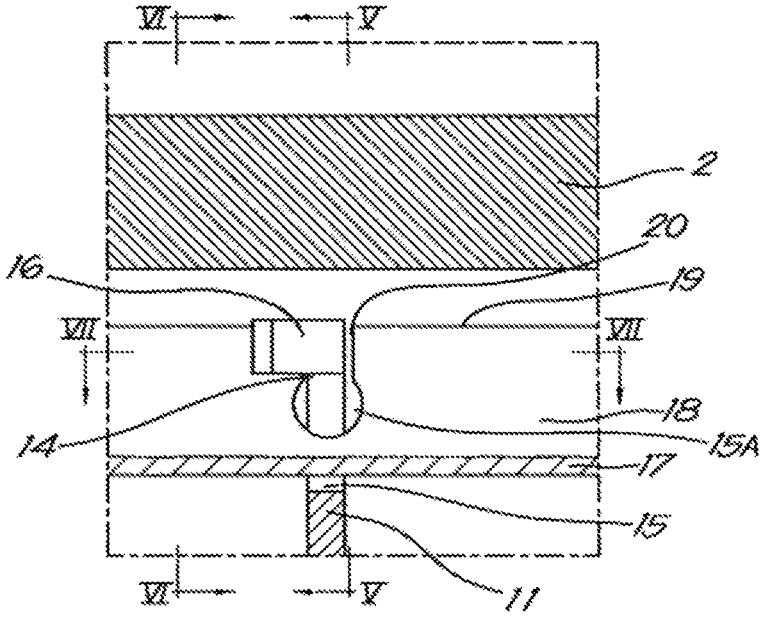
FIG. 4 shows the section indicated by F4 in FIG. 1 on a larger scale.
Figure 5:
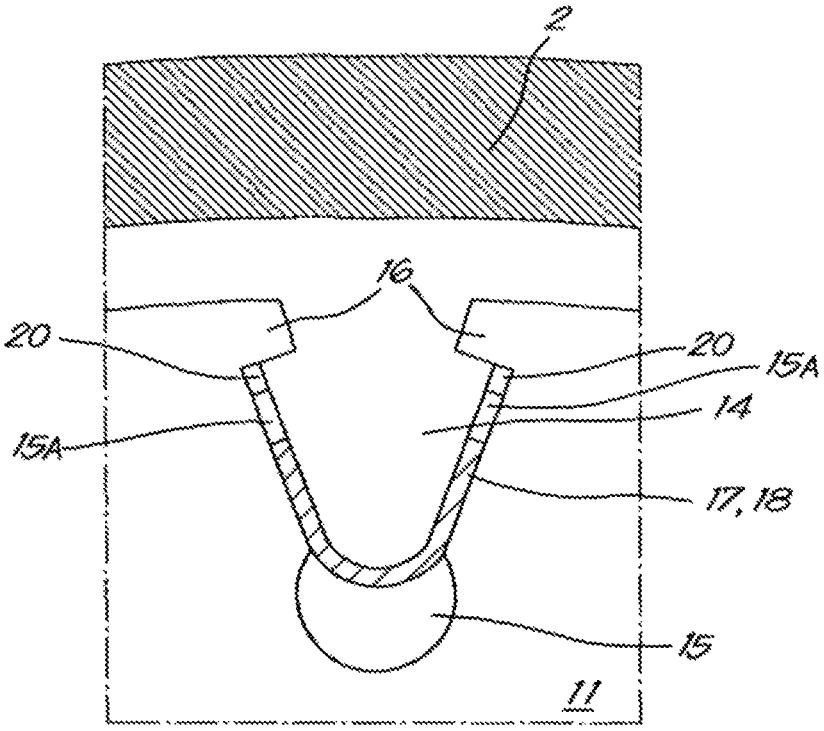
Figure 6:
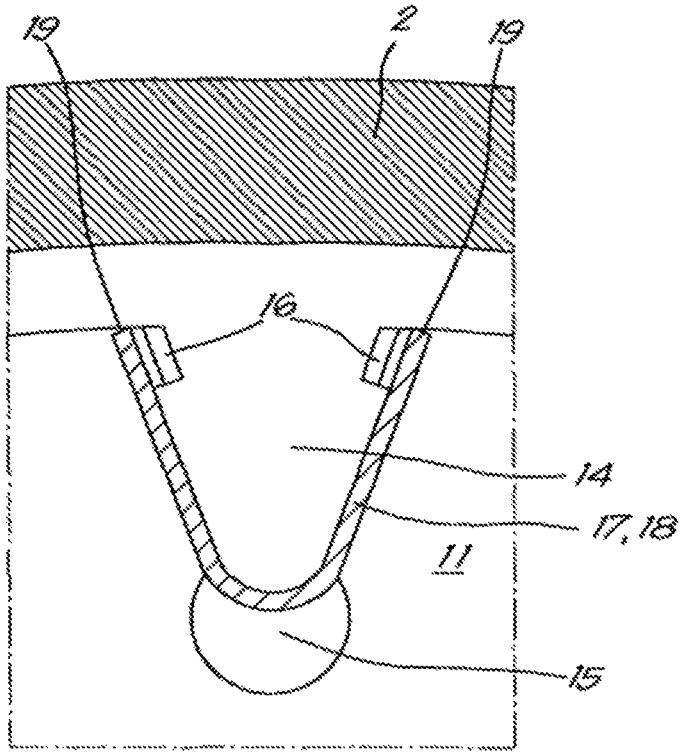
Figure 7:
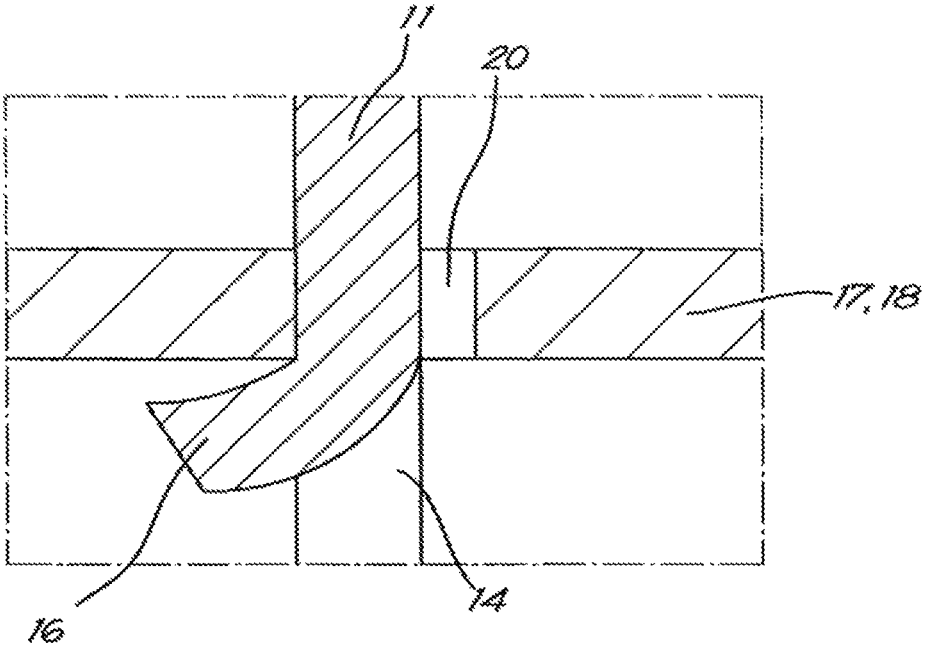
FIG. 7 shows a cross-section according to line VII-VII in FIG. 4.

Preferably the free edges 19 of the fastening elements 17 extend in the mounted situation to practically the peripheral edge of the baffles 11, as shown in FIGS. 4 to 6.

The manufacture of such a shell and tube heat exchanger 1 is analogous to a traditional shell and tube heat exchanger, whereby only the making of the connections between the baffles 11 and the fastening elements 17 is hereby further explained.

To this end the baffles 11 are held in the desired orientation and with the desired mutual distance between on an assembly table.

Then the fastening elements 17, at the location of their second recesses 20, are placed in the first recesses 14. This can be done without squeezing the fastening elements 17 together at their free edges 19, but simply by somewhat tilting the fastening elements 17 so that they can pass along the lips 16.

Then using special pliers 21 the lips 16 are bent over. This is shown in FIG. 8, in which the pliers 21 are equipped to bend the lips 16 upwards, i.e. out of the plane of the paper, to form a connection.

The special pliers 21 consist of two parts that are connected together by a pivot. The first part 22 has a forked end with two arms 23 between which the distance is greater than the size of the first recess 14. The second part 24 has a flat end, that is smaller than the inside dimension of the fastening elements 17, but is larger than the mutual distance between the lips 16.

Figure 8:
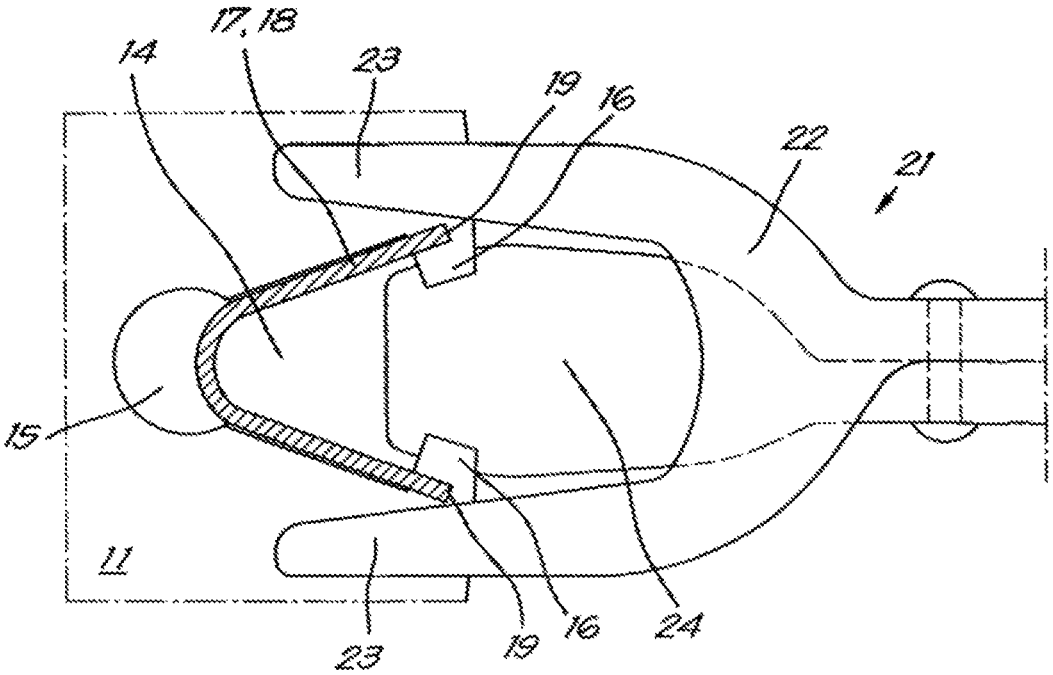
FIG. 8 shows a step of a method for manufacturing a shell and tube heat exchanger according to FIG. 1.

By squeezing the pliers 21 together, when correctly placed around a first recess 14, as shown in FIG. 8, the lips 16 are bent out of the plane of the partition 11.

The use of the shell and tube heat exchanger 1 according to the invention is analogous to that of the known shell and tube heat exchangers.

The present invention is by no means limited to the embodiment described as an example and shown in the drawings, but a shell and tube heat exchanger and method according to the invention can be realised in all kinds of forms and dimensions, without departing from the scope of the invention.

The invention claimed is:

1. A shell and tube heat exchanger for exchanging heat between a first and second fluid, whereby the heat exchanger comprises a housing in which one or more tubes extend between an inlet section for the first fluid and an outlet section for the first fluid, whereby baffles are affixed in the housing, whereby the baffles are provided with passages, whereby the one or more tubes extend through the said passages, whereby the baffles are connected to one another at a distance from one another by means of one or more fastening elements that are affixed in first recesses in the baffles, wherein one or more connections between a said baffle and a said fastening element are formed by one or more lips that are made at an edge of a first recess, whereby the one or more lips form part of the baffle and whereby the one or more lips are bent over, out of the plane defined by the baffle.

2. The shell and tube heat exchanger according to claim 1, wherein the said first recesses are located along the outer periphery of the baffles.

3. The shell and tube heat exchanger according to claim 1, wherein the said one or more fastening elements are connected to all said baffles.

4. The shell and tube heat exchanger according to claim 1, wherein the one or more fastening elements extend in a direction parallel to the tubes.

5. The shell and tube heat exchanger according to claim 1, wherein the one or more fastening elements extend in a direction perpendicular to the baffles.

6. The shell and tube heat exchanger according to claim 1, wherein the one or more fastening elements are essentially formed by profiles, whereby the form of the first recesses at least partially corresponds to the form of the outer periphery of these profiles, viewed in the cross-section transverse to the profile direction, and whereby optionally these profiles are provided with second recesses at the location of the first recesses, or are provided with protrusions just next to the first recesses.

7. The shell and tube heat exchanger according to claim 1, wherein the one or more fastening elements are formed by one or more profiles with a V-shaped cross-section transverse to the profile direction, whereby these one or more profiles at the location of the first recesses are provided with second recesses, whereby the first recesses are at least partially V-shaped, and whereby the said lips are affixed on two opposite edges of the first recesses.

8. The shell and tube heat exchanger according to claim 1, wherein the one or more fastening elements are provided with a second recess at the location of the said connections, whereby the one or more lips are partially in the second recess and whereby the one or more lips are bent around an edge of the second recess.

9. The shell and tube heat exchanger according to claim 1, wherein the said baffles are provided with two said lips at the said first recesses, whereby these lips are bent in a mutually opposite direction, out of the plane defined by the baffle.

10. The shell and tube heat exchanger according to claim 1, wherein the said baffles are provided with two said lips at the said first recesses, whereby the lips are bent in the same mutual direction, out of the plane defined by the baffle.

11. A method for fastening baffles of a shell and tube heat exchanger to one another at a desired distance from one another, whereby the baffles are provided with one or more first recesses for receiving one or more fastening elements that at least span the desired distance, whereby the baffles are provided with one or more lips that are affixed at an edge of such a first recess, wherein this method comprises the following step:

bending the one or more lips until they protrude outside the plane defined by the baffle.

12. The method according to claim 11, wherein at least two lips are bent over per said first recess, whereby these at least two lips are bent in the same mutual direction.

13. The method according to claim 11, wherein at least two lips are bent over per said first recess, whereby two of these at least two lips are bent in the opposite mutual direction.

14. The method for manufacturing a shell and tube heat exchanger according to claim 11, wherein this method produces an exchanger comprising a housing in which one or more tubes extend between an inlet section for the first fluid and an outlet section for the first fluid, whereby baffles are affixed in the housing, whereby the baffles are provided with passages, whereby the one or more tubes extend through the said passages, whereby the baffles are connected to one another at a distance from one another by means of one or more fastening elements that are affixed in first recesses in the baffles, wherein one or more connections between a said baffle and a said fastening element are formed by one or more lips that are made at an edge of a first recess, whereby the one or more lips form part of the baffle and whereby the one or more lips are bent over, out of the plane defined by the baffle.

* * * * *